US008420957B2

(12) United States Patent
Berti

(10) Patent No.: US 8,420,957 B2
(45) Date of Patent: Apr. 16, 2013

(54) METHOD FOR WEIGHING LAUNDRY BY MEASURING ENERGY USED BY A DRUM MOTOR AT DIFFERENT ANGULAR SPEEDS

(75) Inventor: Luciano Achille Luigi Berti, Bussero (IT)

(73) Assignee: Grandimpianti Ile Ali S.p.a., Sospirolo (IT)

( * ) Notice: Subject to any disclaimer, the term of this patent is extended or adjusted under 35 U.S.C. 154(b) by 260 days.

(21) Appl. No.: 12/801,382

(22) Filed: Jun. 7, 2010

(65) Prior Publication Data

US 2010/0320007 A1 Dec. 23, 2010

(30) Foreign Application Priority Data

Jun. 17, 2009 (IT) ..... PD2009A0174

(51) Int. Cl.
*D60F 33/00* (2006.01)
*G01G 19/00* (2006.01)
*G01G 19/52* (2006.01)

(52) U.S. Cl.
USPC ..... 177/1; 177/245; 68/12.04

(58) Field of Classification Search ..... 68/12.04; 177/1, 245
See application file for complete search history.

(56) References Cited

U.S. PATENT DOCUMENTS

| | | | | |
|---|---|---|---|---|
| 5,507,054 | A | 4/1996 | Blauert et al. | |
| 5,507,055 | A | 4/1996 | Blauert et al. | |
| 7,484,258 | B2 * | 2/2009 | Kim et al. | 8/158 |
| 7,942,023 | B2 * | 5/2011 | Kanazawa | 68/12.04 |
| 2005/0015890 | A1 * | 1/2005 | Kim et al. | 8/158 |
| 2005/0016226 | A1 | 1/2005 | Okazaki | |
| 2005/0044641 | A1 * | 3/2005 | Hyeong | 8/159 |
| 2005/0050646 | A1 | 3/2005 | Lee et al. | |
| 2006/0179584 | A1 * | 8/2006 | Choi et al. | 8/158 |
| 2006/0185095 | A1 | 8/2006 | Mitts | |
| 2006/0207299 | A1 * | 9/2006 | Okazaki et al. | 68/12.02 |
| 2007/0193310 | A1 | 8/2007 | Penteado et al. | |
| 2008/0041115 | A1 * | 2/2008 | Kanazawa et al. | 68/12.04 |
| 2009/0199598 | A1 * | 8/2009 | Kanazawa | 68/12.04 |

FOREIGN PATENT DOCUMENTS

| | | | |
|---|---|---|---|
| EP | 1 512 785 | A1 | 3/2005 |
| EP | 1 693 498 | A2 | 8/2006 |
| EP | 2 009 169 | A2 | 12/2008 |
| EP | 2009169 | A2 | 12/2008 |
| WO | WO 2004/081276 | A1 | 9/2004 |

* cited by examiner

*Primary Examiner* — Randy W Gibson
(74) *Attorney, Agent, or Firm* — Modiano & Associati; Albert Josif; Daniel O'Byrne

(57) ABSTRACT

A method for weighing laundry inside a washing machine comprises a first step of optimization of the distribution of the laundry in the basket, a second step of definition of a flywheel of laundry with a constant moment of inertia, and a third step of measurement of the energy absorbed by the motor drive for moving the basket during a predefined angular acceleration of the loaded basket.

7 Claims, 1 Drawing Sheet

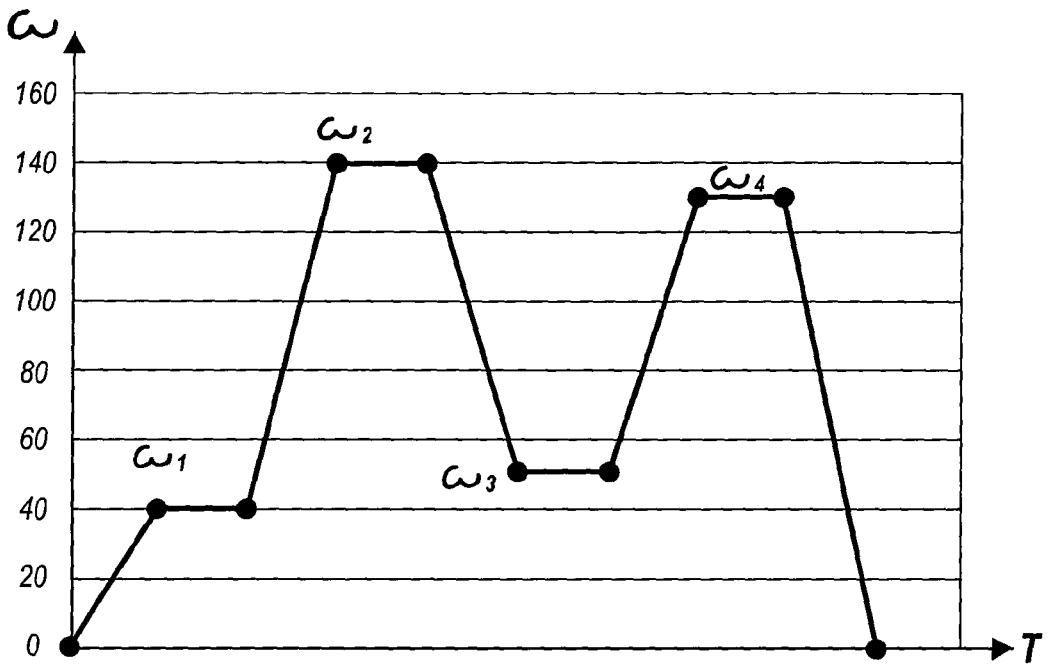
ω
160
140
120
100
80
60
40
20
0
ω1
ω2
ω3
ω4
T

METHOD FOR WEIGHING LAUNDRY BY MEASURING ENERGY USED BY A DRUM MOTOR AT DIFFERENT ANGULAR SPEEDS

The present invention relates to a method for weighing a mass of laundry to be washed inside a washing machine.

BACKGROUND OF THE INVENTION

The washing cycle of a washing machine, in order to be executable in a complete and optimum manner, entails a sequence of various steps during which the laundry is subjected to the treatments required to reach the desired cleaning result.

The resources that are used generally by the machine during the washing cycle are generally water and detergent in order to provide the washing cycles, electric power for the operation of an electric motor that moves the basket, and electric power, steam or hot water for heating the washing bath.

The research performed in the field by the Applicant, as well as the experience acquired, teach that there is an optimum ratio between the quantity of water necessary for washing the laundry with rinsing and the mass of laundry introduced in the washing machine.

During its whole service life, the washing machine performs various washing actions, repeating continuously the programmed cycles, in different load situations.

Over time, a washing machine performs washes in a completely automatic manner, complying with the programming defined at the time of its purchase, of its installation as well as the programming performed by the user.

Generally, these cycles are adapted to operate with the maximum allowable load.

If the machine, for totally arbitrary reasons, is not loaded completely, but is used only for part of its capabilities with respect to the nominal capacity, the washing machine uses nonetheless the nominal quantity of water inside the bath, even when this would not be necessary.

Consequently, in such conditions, more resources will be used than actually needed by the apparatus for treating the load of laundry that has been introduced.

The operation of the washing machine with partial load entails a series of indirect consumptions, such as:

longer water loading time than actually needed;

greater consumption of detergent;

greater quantity of water;

greater quantity of energy required to heat the mass of water that is present;

periods of time that are longer than necessary in order to provide each specific washing step, which leads to a longer total duration of the cycle;

incorrect mechanical washing action.

These listed items have operating costs for the washing activity, which is of primary importance in the case of industrial washing machines.

Moreover, the fact that the washing machine with a partial load is used for a time that is longer than the theoretical one for which it could provide a cycle also entails a smaller capacity of the washing machine to amortize its own cost, without reducing likewise the use of human resources assigned to its use and its maintenance.

Devices are currently known and commercially available that allow to weigh the quantity of laundry loaded into a washing machine, so as to be able to optimize the quantity of water introduced in the basket.

Generally, these systems are constituted by mechanical means associated with known electronic sensors capable of detecting the weight of the entire apparatus: if the tare is known, the difference in weight is constituted by the laundry alone.

Such a system, however, has the drawback of not being very precise because of the great importance of the factor constituted by the weight component of the structure of the washing machine with respect to its loading capacity.

Moreover, such system is stressed continuously during the normal operation of the washing machine and can thus reappear at the new loading test in conditions that are different and not optimal with respect to the predefined ones.

A second type of system is also known which is constituted by variations of the system cited above, adapted to evaluate the weight of the laundry containment basket alone, so as to be more accurate than systems that weigh the washing machine in its entirety.

The greatest drawback of this second type of systems resides in any case in that it provides for the use of a set of components that have a considerable cost, which can sometimes be compared to the cost of the washing machine itself.

A third type of weighing system provides for the control of the power used to move the basket.

By way of this measurement it is possible to distinguish whether the washing machine is empty, or fully loaded or partially loaded, with the consequent automatic setup of the so-called half-load operation, as occurs for domestic washing machines.

This half-load detection is in any case very approximate and does not involve the evaluation of a precise value of the mass of the laundry that can be used validly for precise recalculation of the values of water, detergent and cycle times.

SUMMARY OF THE INVENTION

The aim of the present invention is to provide a method for weighing laundry to be washed inside a washing machine that is capable of solving the drawbacks shown by known types of weighing system and device.

Within this aim, an object of the invention is to provide a weighing method capable of giving, with acceptable precision, the quantity of laundry inserted in the washing machine to which is applied.

Another object of the invention is to provide a weighing method that allows to obtain a value of the mass of laundry to be washed that can be used conveniently for an actual optimization of the water loading times, of the quantity of detergent, of the quantity of water, of the amount of power needed to heat the mass of water that is present and of the duration of the washing steps.

Another object of the invention is to provide a weighing method aimed at reducing not only the costs mentioned above but also the environmental impact of the washing machine.

Another object of the invention is to propose a method for weighing a mass of laundry to be washed inside a washing machine that is easy to apply to any washing machine, without the need to install thereon particular devices or provide specific modifications thereof.

This aim and these and other objects that will become better apparent hereinafter are achieved by a method for weighing laundry inside a washing machine, particularly for industrial washing machines, characterized in that it comprises the following steps:

a first step of optimization of the distribution of the laundry in the basket, a second step of definition of a flywheel of laundry with a constant moment of inertia, a third step of measurement of the energy absorbed by the motor drive for moving the basket during a predefined angular acceleration of the loaded basket.

DESCRIPTION OF THE PREFERRED EMBODIMENTS

Further characteristics and advantages of the invention will become better apparent from the following detailed description of a preferred but not exclusive embodiment of the method according to the invention, shown schematically by way of non-limiting example in the accompanying FIG. 1, which plots a chart in which a time scale is on the abscissa-axis and a scale related to the angular speed is on the ordinate-axis.

A method for weighing laundry inside a washing machine, particularly for industrial washing machines, according to the invention, is characterized in that it comprises the following steps:

a first step of optimization of the distribution of the laundry in the basket, a second step of definition of a flywheel of laundry with a constant moment of inertia, a third step of measurement of the energy absorbed by the motor drive for moving the basket during a predefined angular acceleration of the loaded basket.

The first step of optimization of the distribution of the laundry in the basket of the washing machine, to which the method according to the invention is applied, entails starting the stationary basket, accelerating its rotational condition from $\omega 0=0$ to a first rotation speed, hereafter referenced as intermediate, $\omega 1$.

This first rotation speed $\omega 1$ is, for example, comprised within the so-called intermediate speed interval, which is comprised between 20 rpm and 200 rpm, according to the dimensions of the basket.

At this first speed the centrifugal component of the force that acts on the laundry is comparable to the weight of such laundry and therefore the laundry tends to distribute itself and to adhere to the basket that contains it.

The expression "flywheel of laundry" designates the mass of laundry distributed in a stable and substantially balanced manner against the internal surface of the basket.

The second step of formation of a flywheel of laundry with a constant moment of inertia is performed by accelerating the loaded basket up to a second speed $\omega 2$, termed high speed, which is higher than $\omega 1$.

This acceleration entails the formation and settling of the flywheel of laundry; in fact the laundry at this rotation speed, referenced as "high rotation speed", is subjected predominantly to the stress caused by the centrifugal force and continues to adhere to the basket in any rotational condition above $\omega 1$.

At this rotation speed, the moment of inertia Itot of the system constituted by the basket and the laundry can be considered to remain substantially constant even when the rotation speed decreases within the intermediate speed interval.

The third step of measurement of the energy absorbed by the motor drive for moving the basket during a predefined angular acceleration of the loaded basket provides for:

lowering the rotation speed of the loaded basket from $\omega 2$ to a third rotation speed $\omega 3$ that is higher than $\omega 1$ and thus intermediate between $\omega 2$ and $\omega 1$ and a subsequent acceleration up to a speed $\omega 4$ that is lower than $\omega 2$ and higher than $\omega 1$.

In this step it is assumed that the moment of inertia Itot remains substantially constant.

Then the energy absorbed by the motor drive for moving the basket during the angular acceleration of the loaded basket from $\omega 3$ to $\omega 4$ is measured.

The rotation of the basket is then stopped.

Since it is known from physics that:

$$\Delta E=Ef-Ei=\tfrac{1}{2}I(\omega f^2-\omega i^2)$$

by measuring

Ef, i.e., the energy stored by the basket-motor drive system at the speed $\omega 3$ Ei, i.e., the energy stored by the basket-motor drive system at the speed $\omega 4$, and since $\omega 3$ and $\omega 4$ are known and set beforehand, Itot is determined.

By thus assuming that the initial and final conditions of rotation are set in advance, it is possible to identify a direct proportion between the energy exchanged by the system and the mass of laundry to be turned.

The value of the mass of laundry is obtained, also by confirmation by means of empirical tests, by using a function of correlation between the energy values absorbed by the system and the load of laundry that is present inside the basket.

The energy value read for the angular acceleration of the mass comprises two contributions: one for the acceleration of the assembly formed by the motor drive and the empty basket, plus the contribution due to the presence of the laundry.

By performing weighing measurements with the basket empty, the fraction of energy due to the basket is known and is used in order to determine the net value related to the laundry alone.

Of course, the system can be set whenever necessary, in order to be able to recalibrate the zero value of the basket after maintenance, wear or other events.

The energy supplied to the system during the entire weighing step can be detected accurately, by way of adapted measurement instruments, which are typically integrated directly in the variable-speed drive that characterizes current washing machines.

The value of the mass of laundry to be washed obviously must be related, by means of an adapted algorithm implemented for the electronic control unit of the washing machine, to the other variables in order to manage the washing machine automatically.

In practice it has been found that the invention achieves the intended aim and objects.

In particular, the advantage of the adoption of this weighing method is that it is extremely simple from a conceptual and application point of view.

To implement weighing by way of this method it is in fact not necessary to modify the construction of a known washing machine in any manner: any existing washing machine can weigh the laundry with this method and know the load that has been introduced.

Moreover, no additional or expensive components are necessary in order to make this method operational.

Since there are no components that have to be introduced in the washing machine, there is no maintenance to be performed and there are no additional wearing parts; accordingly, the reliability of the method is total.

The only wear that is present is due to the natural aging of the washing machine, with loss of any electrical or mechanical characteristics: in any case, the method entails the possibility to perform a calibration automatically directly on the part of the user, without having to request the intervention of technical support.

Moreover, the overall improvement of the performance of the washing machine that is obtained by way of the substantially precise assessment of the mass of laundry allows to extend the life of the washing machine itself.

Finally, this method is the same for the whole range of washing machines, independently of their dimensions or loading capacities, and therefore the use of this method according to the invention does not entail any complication from an industrial point of view.

Moreover, the invention provides a weighing method capable of giving, with acceptable precision, the quantity of laundry inserted in the washing machine to which is applied.

Moreover, the invention provides a weighing method that allows to obtain a value of the mass of laundry to be washed that can be used advantageously for an actual optimization of water loading times, of the quantity of detergent, of the quantity of water, of the quantity of energy necessary to heat the mass of water that is present and of the duration of the washing steps; consequently, the mechanical action applied to the laundry also is finally optimized according to the selected type of cycle and according to the weight detected by the device.

Moreover, the invention has provided a weighing method that reduces not only the costs cited earlier but also the environmental impact of the washing machine.

Moreover, the invention provides a method for weighing a mass of laundry to be washed inside a washing machine that is easy to apply to any washing machine without the need to install particular devices thereon or provide specific modifications thereof.

The invention thus conceived is susceptible of numerous modifications and variations, all of which are within the scope of the appended claims.

The disclosures in Italian Patent Application No. PD2009A000174 from which this application claims priority are incorporated herein by reference.

What is claimed is:

1. A method for weighing laundry inside a washing machine, comprising:

a first step of a distribution of laundry in a basket of a washing machine by rotation said basket at a first angular rotation speed ω1, a second step of rotating said basket at a second angular rotation speed ω2 that is higher than said first angular rotation speed ω1 so that the mass of laundry is distributed in a stable and substantially balanced manner against an internal surface of the basket thereby to provide a flywheel of laundry with a constant moment of inertia; and a third step of measurement of an energy absorbed by a motor drive for moving the basket of the washing machine during an angular acceleration of the loaded basket at a third angular rotation speed ω3 and a fourth angular rotation speed ω4 each having a value between said first and second angular rotation speeds ω1, ω2.

2. The method of claim 1, wherein said first step entails starting the basket which is stationary, accelerating a rotational condition of the basket from an initial rotation speed ω0 equal to zero to said first rotation speed ω1 that is comprised within an intermediate speed interval and at which a centrifugal component of a force that acts on the laundry is comparable to a weight of the laundry and therefore the laundry tends to adhere to the basket.

3. The method of claim 2, wherein said intermediate speed interval is comprised between 20 rpm and 200 rpm.

4. The method of claim 2, wherein said second step is performed by accelerating the loaded basket up to said second speed ω2 such that the laundry is subjected predominantly to a stress caused by centrifugal force and continues to adhere to the basket at every rotation speed comprised between said first and second angular rotation speeds ω1, ω2.

5. The method of claim 4, comprising rotation said basket at said first angular rotation speed ω1 and subsequently at said second angular rotation speed ω2 such that a moment of inertia hot of a system constituted by the basket and the laundry can be considered substantially constant even when decreasing a rotation speed within the intermediate speed interval comprised between said first and second angular rotation speeds ω1, ω2.

6. The method of claim 4, wherein said third step provides for:

lowering of a rotation speed of the loaded basket from said second rotation speed ω2 to said third rotation speed ω3 that is higher than said first angular rotation speed ω1, and a subsequent acceleration up to a said fourth rotation speed ω4 that is lower than said second annular speed ω2, said third step comprising measurement of an energy absorbed by the motor drive for moving the basket during angular acceleration of the loaded basket from said third rotation speed ω3 to said fourth rotation speed ω4.

7. The method of claim 6, comprising performing measurement of the energy absorbed by the motor drive when the basket is empty, and obtaining a known fraction of energy, said known fraction of energy due to the basket being further used to identify a net value of absorbed energy related to the laundry alone.

* * * * *